US006688462B2

(12) United States Patent
Clay

(10) Patent No.: US 6,688,462 B2
(45) **Date of Patent: *Feb. 10, 2004**

(54) APPARATUS AND METHODS FOR PACKAGING AND DISTRIBUTING COMBINATIONS OF COMPLEMENTARY CONTAINERS

(75) Inventor: Forrest Kelly Clay, 1218 Linden La., Worland, WY (US) 82401

(73) Assignee: Forrest Kelly Clay

( * ) Notice: Subject to any disclaimer, the term of this patent is extended or adjusted under 35 U.S.C. 154(b) by 0 days.

This patent is subject to a terminal disclaimer.

(21) Appl. No.: 10/037,893

(22) Filed: Oct. 23, 2001

(65) Prior Publication Data

US 2002/0056661 A1 May 16, 2002

Related U.S. Application Data

(63) Continuation of application No. 09/922,976, filed on Aug. 6, 2001, which is a continuation-in-part of application No. 09/618,194, filed on Jul. 18, 2000, now Pat. No. 6,293,393.

(51) Int. Cl.[7] ..... B65D 85/00
(52) U.S. Cl. ..... 206/217
(58) Field of Search ..... 53/171, 397, 398, 53/441, 442, 445, 449; 206/139, 140, 216–218, 427, 434, 497, 541, 545, 549; 229/120.01

(56) References Cited

U.S. PATENT DOCUMENTS

| | | | | | |
|---|---|---|---|---|---|
| 2,287,729 | A | | 6/1942 | Fallert | 229/51 |
| 2,290,971 | A | | 7/1942 | King | 229/52 |
| 2,487,293 | A | | 11/1949 | Belsinger | 229/15 |
| 2,694,518 | A | | 11/1954 | Zanck et al. | 229/15 |
| 3,195,719 | A | * | 7/1965 | Giesler | 206/216 |
| 3,759,373 | A | | 9/1973 | Werth et al. | 206/65 C |
| 3,759,378 | A | * | 9/1973 | Werth | 229/120.011 |
| 4,078,357 | A | | 3/1978 | Ida | 53/26 |
| 4,269,308 | A | | 5/1981 | Platt | 206/150 |
| 4,471,870 | A | | 9/1984 | Uhlig | 206/150 |
| 4,533,052 | A | | 8/1985 | Fruchey et al. | 206/602 |
| 4,795,028 | A | | 1/1989 | Wittig et al. | 206/217 |
| 4,819,793 | A | | 4/1989 | Willard et al. | 206/162 |
| 4,919,260 | A | | 4/1990 | Cunningham | 206/150 |
| 5,056,659 | A | | 10/1991 | Howes et al. | 206/217 |
| 5,299,733 | A | | 4/1994 | Werth | 229/120.011 |
| 5,372,827 | A | | 12/1994 | Brauner et al. | 426/106 |
| 5,657,874 | A | | 8/1997 | Hustad et al. | 206/764 |
| 5,664,671 | A | | 9/1997 | Nedblake, Jr. | 206/217 |
| 5,676,244 | A | | 10/1997 | Green et al. | 206/221 |
| 5,727,679 | A | | 3/1998 | Newarski | 206/222 |
| 5,765,336 | A | | 6/1998 | Neagle et al. | 53/201 |
| 5,816,411 | A | | 10/1998 | Smith | 206/782 |
| 5,996,316 | A | | 12/1999 | Kirschner | 53/443 |
| 6,003,287 | A | | 12/1999 | Ballestrazzi et al. | 53/546 |
| 6,026,952 | A | | 2/2000 | Brooks | 206/216 |
| 6,058,679 | A | | 5/2000 | Ziegler et al. | 53/448 |
| 6,123,214 | A | | 9/2000 | Goebel | 220/23.4 |
| 6,293,393 | B1 | | 9/2001 | Clay | 206/217 |

* cited by examiner

*Primary Examiner*—Jim Foster
(74) *Attorney, Agent, or Firm*—Woodcock Washburn LLP

(57) ABSTRACT

Combined packages including a plurality of complementary containers are disclosed. A first such container is a first generally rectanguloidal container that contains a first item and a second such container is a second generally rectanguloidal container that contains a second item that is different from and complementary to the first item. A packaging material at least partially surrounds each of the containers, thus holding the container in mutual abutment. A combined package can also include an adhesive between the containers that holds a face of the first container and a face of the second container in mutual abutment. To facilitate palletizing the combined packages, the overall shape of the combined package can be generally rectanguloidal. The first container can have a plurality of faces, each of which is generally coplanar with a respective face of the second container. Apparatus and methods for manufacturing such combined packages are also disclosed.

36 Claims, 7 Drawing Sheets

APPARATUS AND METHODS FOR PACKAGING AND DISTRIBUTING COMBINATIONS OF COMPLEMENTARY CONTAINERS

CROSS-REFERENCE TO RELATED APPLICATIONS

This application is a continuation of U.S. patent application Ser. No. 09/922,976, filed Aug. 6, 2001, which is a continuation-in-part of U.S. patent application Ser. No. 09/618,194, filed Jul. 18, 2000, now U.S. Pat. No. 6,293,393. The subject matter disclosed herein is related to the subject matter disclosed in U.S. patent application Ser. No. 09/957,904, filed Sep. 21, 2001. The contents of each of the above-referenced patents and patent applications are hereby incorporated herein by reference.

FIELD OF THE INVENTION

This invention relates to apparatus and methods for packaging and distributing combinations of complementary containers.

BACKGROUND OF THE INVENTION

It is well known that consumers frequently associate certain snack foods and beverages with one another, and that consumers frequently consume snack foods and beverages in combination. For example, consumers might be inclined to eat peanuts when drinking beer, or to eat popcorn when drinking soda. To capitalize on this, the food and beverage industry has attempted to increase sales of both snack foods and beverages by tying sales of certain beverages to sales of snack food products that are often associated with those beverages. For example, the seller of popcorn might offer the popcorn purchaser a "cents-off" coupon that can be redeemed with the purchase of a case of soda, or the seller of peanuts might offer a peanut coupon to the purchaser of a case of beer.

Although this approach provides the beverage purchaser, for example, with an incentive to purchase the snack food, such an approach requires the purchaser to actually retrieve both the beverage and the snack food. The extra effort required to locate the additional item, and then carry it or place it into the shopping cart is often just enough to discourage the purchaser from making the additional purchase. Even if the snack food item is placed in reasonable proximity to the beverage, the consumer can still be dissuaded from buying both the snack food and the beverage by having to pick up and carry more than one item.

Occasionally, the beverage industry offers additional incentives to the purchaser in the form of promotional items (a.k.a. "premiums"). Such promotional items are typically free items that the seller gives to the buyer in exchange for the purchase of the beverages. Examples of such promotional items can include toys, tee shirts, videos, and the like. Like complementary snack food items, the premiums can be offered in separate packages, making it difficult or undesirable for the purchaser to carry both the multi-pack beverage carton and the premium. The premium could be shrink-wrapped, for example, or otherwise attached to the multi-pack beverage carton, but this approach results in an end-product that is difficult to mass-produce, palletize, store, transport, market, and display in large quantities because of its generally odd overall shape. That is, it is difficult to stack a large number of such packages because gaps between adjacent packages cause instability in the stack.

It would be advantageous, therefore, to manufacturers, bottlers, and merchandisers of multi-pack beverage cartons if products and methods were available that entice the consumer to purchase multi-pack cartons of beverage containers in combination with complementary items such as snack foods and promotional items, without requiring the consumer to select and carry separate items. Thus, there is a need in the art for apparatus and methods for packaging and distributing combinations of multi-pack beverage cartons and complementary containers.

SUMMARY OF THE INVENTION

The present invention satisfies these needs in the art by providing apparatus and methods for packaging and distributing combinations of multi-pack beverage cartons and complementary containers. A combined package according to the invention includes a multi-pack carton containing a plurality of beverage containers, combined in mutual abutment with one or more complementary containers. The beverage containers can be cans or bottles, and the multi-pack carton can contain at least six, or preferably twelve, beverage containers. The complementary containers can include a snack food, a promotional item, or any other such item that would entice a consumer to purchase the multi-pack beverage carton in combination with the complementary container.

A packaging material, which can be a transparent, polymeric, packaging material, such as shrink-wrap material or a band, at least partially surrounds both the multi-pack carton and the complementary container, thus holding the multi-pack carton and the container in mutual abutment. The combined package can also include an adhesive between the multi-pack carton and the container that holds a face of the multi-pack carton and a face of the container in mutual abutment. To increase package strength and to facilitate palletizing the combined packages, the surface areas of the faces can be approximately the same, and the combined package can have an overall shape that is generally rectanguloidal.

Apparatus according to the invention for manufacturing a combined package can include a conveyance system, and a packaging material applicator, such as a band applicator or shrink-wrap applicator. The conveyance system transports the multi-pack carton and the complementary container while they are positioned adjacent to one another. The applicator at least partially surrounds both the multi-pack carton and the complementary container with a packaging material that holds them in mutual abutment by applying the packaging material to both the multi-pack carton and the complementary container while they are positioned adjacent to one another. The applicator can include a heat source that shrinks the packaging material or fuses loose ends of the band material together to hold the multi-pack carton and the complementary container in combination.

The apparatus can also include a first conveyor that transports the multi-pack carton and provides the multi-pack carton to the conveyance system, and a second conveyor that transports the complementary container and provides the complementary container to the conveyance system. The first conveyor and the second conveyor meet at a junction adapted to position the multi-pack carton and the complementary container adjacent to one another. An adhesive sprayer can be used to apply an adhesive to at least one of the multi-pack carton and the complementary container to hold the multi-pack carton and the complementary container in mutual abutment.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings an embodiment that is presently preferred, it being understood, however, that the invention is not limited to the specific methods and instrumentalities disclosed.

DETAILED DESCRIPTION OF PREFERRED EMBODIMENTS

Figure 1:
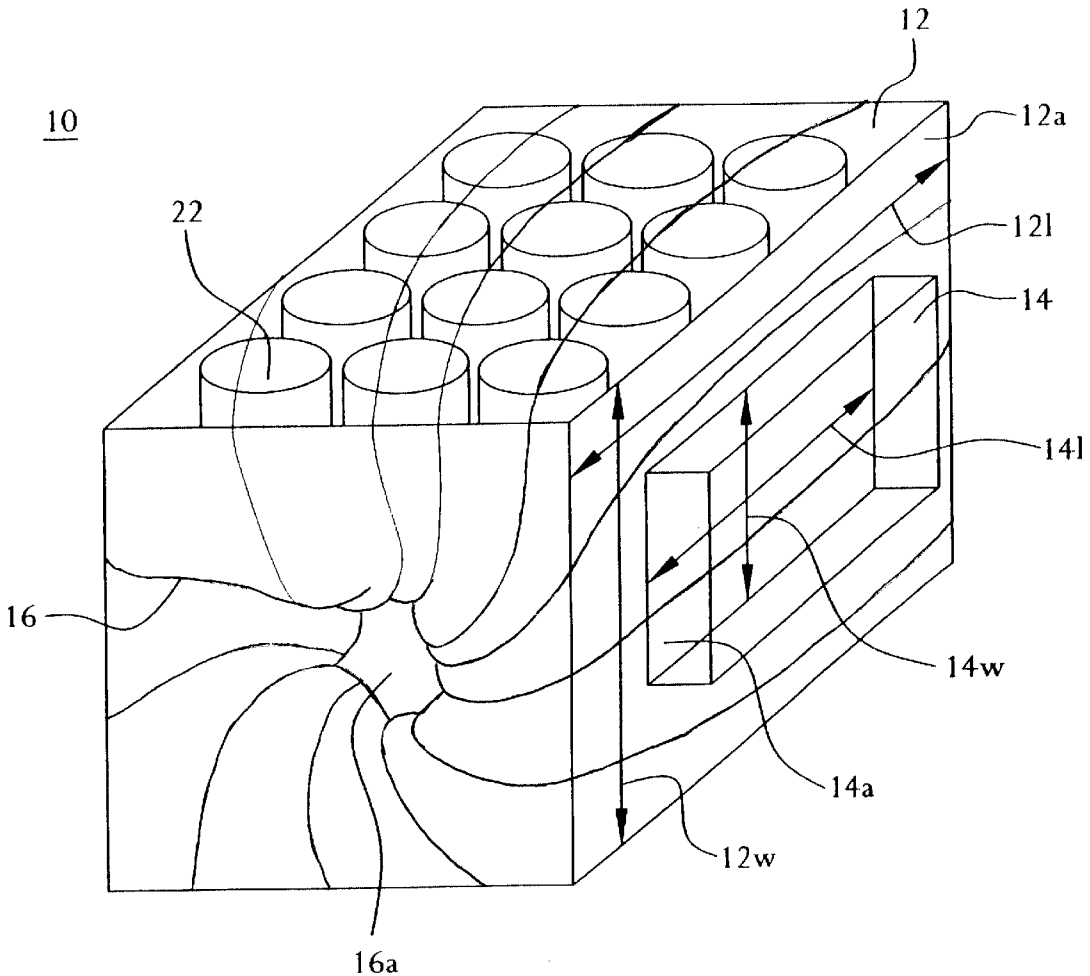
FIG. 1 depicts a preferred embodiment of a beverage package according to the present invention.

FIG. 1 depicts a preferred embodiment of a beverage package 10 according to the present invention. As shown, package 10 comprises a multi-pack carton 12 and a complementary container 14. Multi-pack carton 12 contains a plurality of beverage containers 22, which can be, for example, cans, bottles, or the like. Carton 12 can be made of cardboard, or any other suitable material, and can include artwork, trademarks, or other attractive design work to enhance the appeal of the product. Preferably, multi-pack carton 12 contains twelve cans of a beverage such as soda, beer, water, or the like.

Generally, container 14 contains an item that is complementary to the beverage. That is, container 14 will serve as an inducement to the consumer to purchase the multi-pack carton 12. Container 14 can be a snack food container that contains a snack food, such as popcorn, peanuts, pretzels, or potato chips, for example. Alternatively, container 14 can contain a promotional item or "premium," such as a toy, tee shirt, video, or the like. Container 14 can be a bag, box, or canister, for example, though container 14 is preferably a box.

A packaging material 16 at least partially surrounds both multi-pack carton 12 and container 14, and thus holds multi-pack carton 12 and container 14 in combination against one another, i.e., in mutual abutment. Preferably, packaging material 16 is a sheet of transparent material, such as a sheet of transparent polymeric material commonly known as "shrink-wrap," for example. It should be understood that the packaging material applies a constrictive force to both the multi-pack carton and the complementary container to hold the multi-pack carton and complementary container in mutual abutment.

It is preferred that packaging material 16 is transparent so that the consumer can see both multi-pack carton 12 and container 14, though it may be desirable to use colored or printed packaging material to further enhance the marketing appeal of combined package 10. The combined package 10 can then be offered for sale as a single product or stock keeping unit (SKU), and labeled with a single product identifier, such as a universal product code (UPC).

Figure 2:
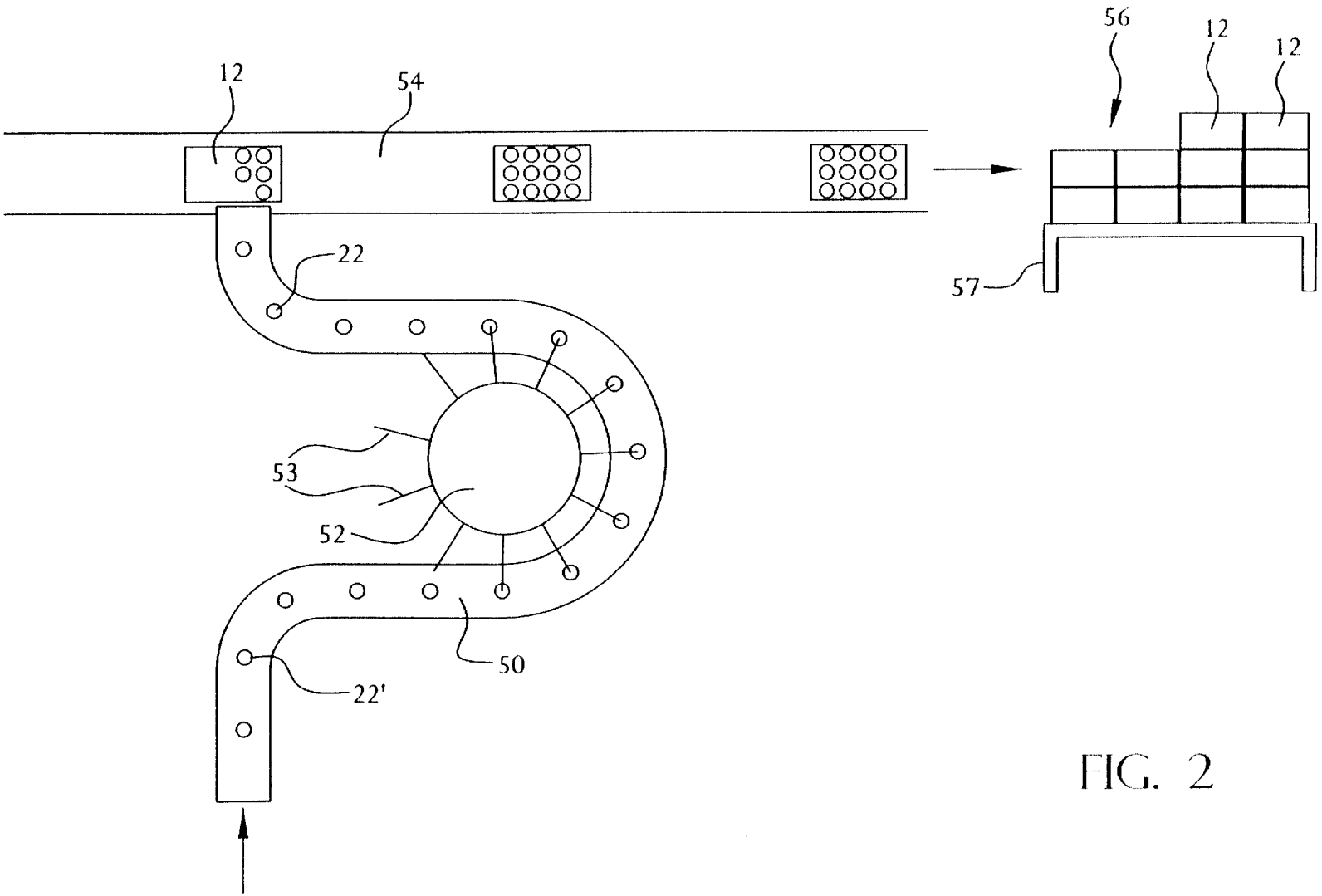
FIG. 2 depicts apparatus for packaging beverages.

Apparatus and methods according to the present invention for manufacturing combinations of multi-pack beverage cartons and complementary containers will now be described. FIG. 2 depicts a top view of apparatus that can be used in a typical bottling operation. As shown, empty beverage containers 22' are transported via a conveyor 50 to be filled as they pass through a filling station 52, which comprises a plurality of filling tubes 53. Once filled, individual beverage containers 22 can be packaged into multi-pack cartons 12. Although any number of beverage containers can be packaged into a multi-pack carton, multi-pack cartons 12 typically contain six, twelve, or twenty-four beverage containers. For purposes of the present invention, it is preferred that multi-pack cartons 12 contain twelve beverage containers 22. Multi-pack cartons 12 can then be transported via a conveyor 54 to be "palletized" (i.e., stacked on pallets 57) at a palletizing area 56.

Figure 3:
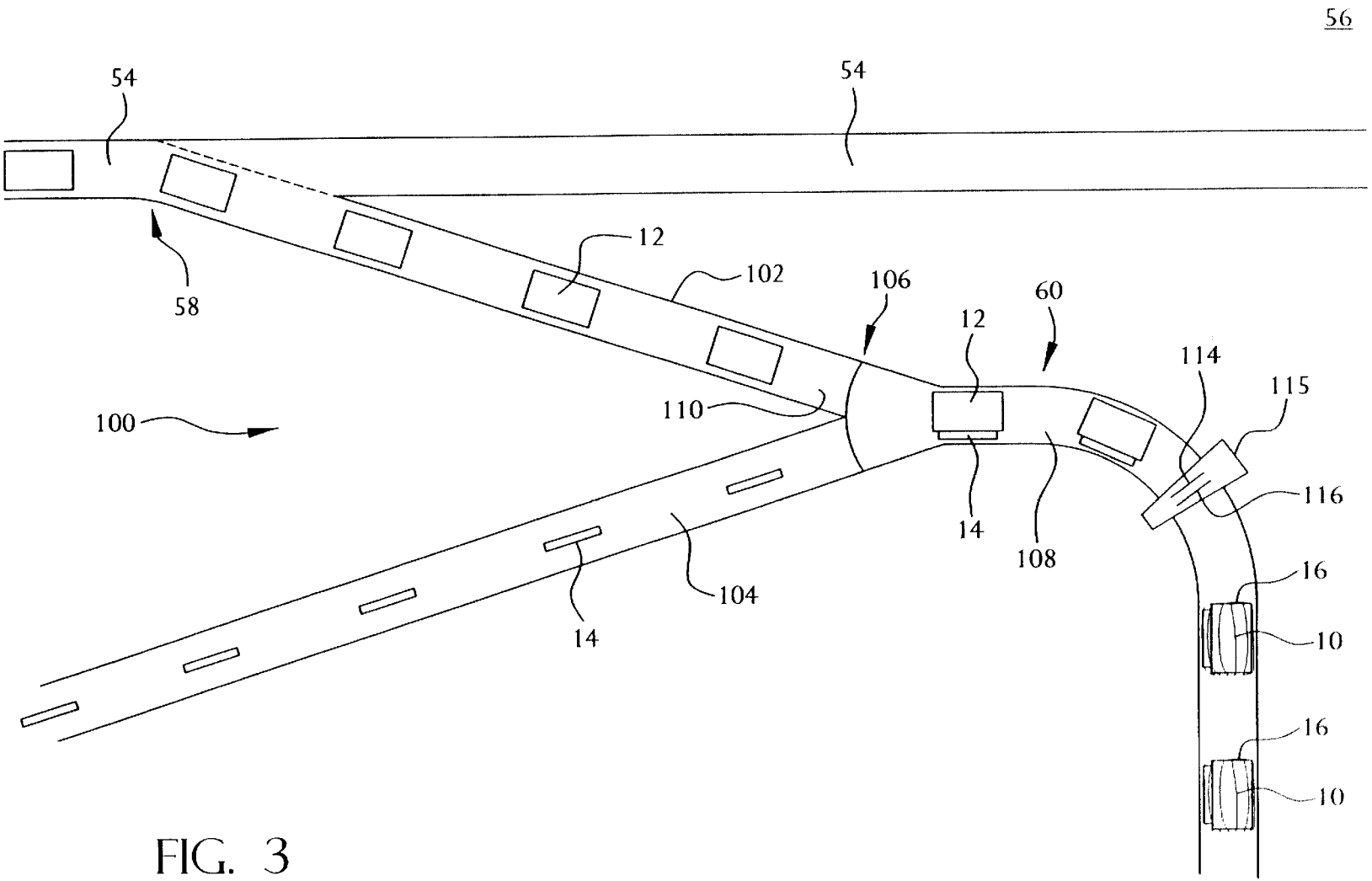
FIG. 3 depicts apparatus according to the present invention for packaging combinations of multi-pack beverage cartons and complementary containers.

FIG. 3 depicts a preferred embodiment of apparatus 100 according to the invention for manufacturing combinations of multi-pack beverage cartons and complementary containers. As shown, conveyor 54 can include a switch 58 so that multi-pack cartons 12 can either continue along conveyor 54 to palletizing area 56 (not shown in FIG. 3), or be switched off via a conveyor 102 to a packaging area 60. Alternatively, conveyor 102 can be separate from conveyor 54, with multi-pack cartons 12 being loaded onto conveyor 102 from a remote location (not shown).

In any event, conveyor 102 transports multi-pack cartons at predefined intervals from one another (i.e., there is a predefined distance between successive cartons on conveyor 102). Similarly, a second conveyor 104 transports containers 14 at predefined intervals from one another. Conveyors 102 and 104 meet at a junction 106, where they can continue side-by-side (i.e., adjacent to one another). More preferably, conveyors 102 and 104 end at junction 106 where a third conveyor 108 begins. Thus, junction 106 can be adapted to cause the multi-pack carton and the complementary container to come into mutual abutment. The intervals between containers 14 should be set so that multi-pack cartons 12 and containers 14 arrive at junction 106 concurrently. Preferably, multi-pack cartons 12 and containers 14 are oriented on their respective conveyors 102, 104 so that when multi-pack cartons 12 and containers 14 meet at junction 106, multi-pack cartons 12 and containers 14 abut against one another as shown.

Thus, at junction 106, carton 12 and container 14 are positioned relative to one another such that face 12*a* of carton 12 is in abutment with face 14*a* of container 14 (see FIG. 1). To facilitate the packaging process, container 14 is preferably configured such that face 14*a* of container 14 has a length 14*l* that is approximately the same as a corresponding length 12*l* of face 12*a* of multi-pack carton 12. More preferably, to facilitate palletizing the combined packages, face 14*a* of container 14 also has a width 14*w* that is approximately the same as a corresponding width 12*w* of face 12*a* of multi-pack carton 12. Thus, in a preferred embodiment, face 12*a* has approximately the same surface area as face 14*a*.

Figure 4B:
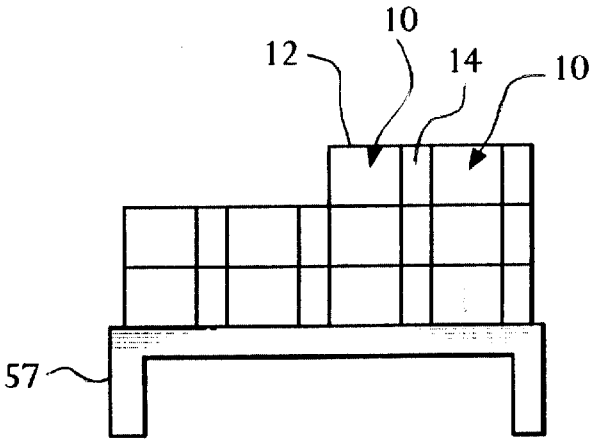
FIGS. 4A and 4B depict a preferred embodiment of a beverage package according to the present invention that is particularly suitable for stacking.
Figure 4A:
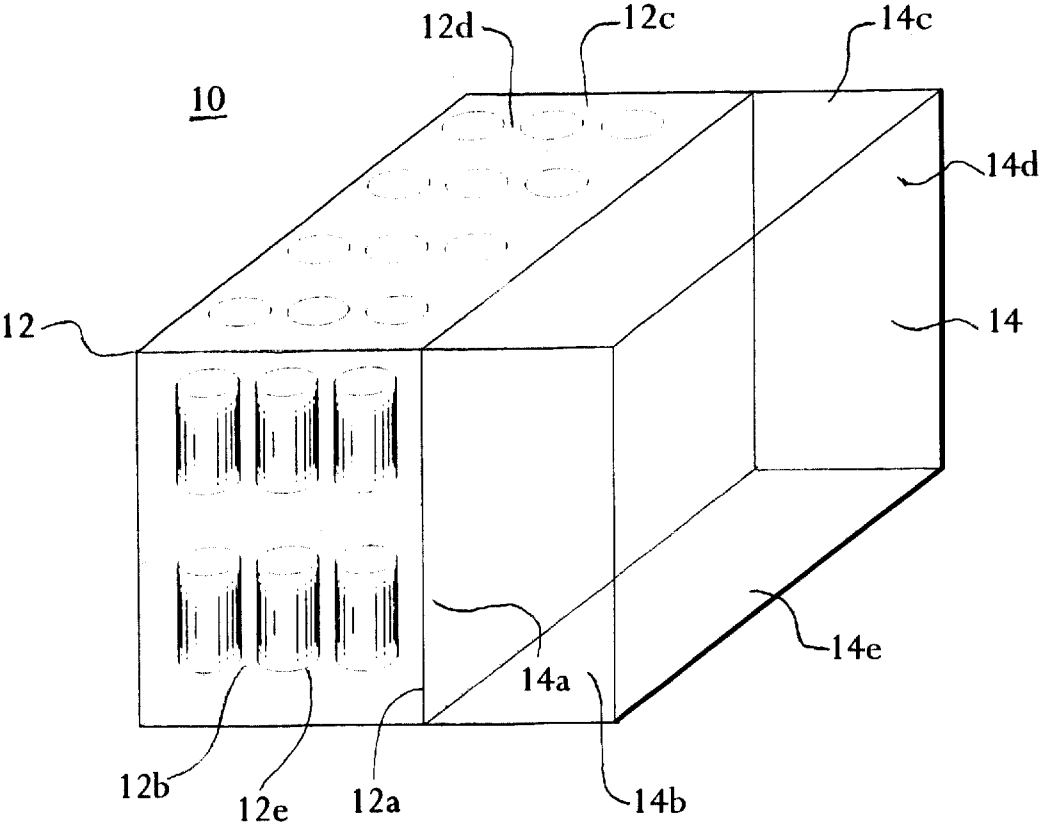

FIG. 4A depicts a preferred embodiment of a beverage package 10 according to the present invention that is particularly suitable for palletizing. As shown, the overall shape of package 10 is rectanguloidal. Such a rectanguloidal shape facilitates palletizing and display of a plurality of such packages because the packages 10 can be stacked next to or on top of one another, in any orientation, without significant gaps between adjacent packages (see FIG. 4B). Carton 12 and container 14 can be sized, shaped, and positioned relative to one another such that faces 12*b*, 12*c*, 12*d*, and 12*e* of carton 12 can be generally coplanar with faces 14*b*, 14*c*, 14*d*, and 14*e*, respectively, of container 14. Because any number of such combined packages can be stacked in any orientation, a combined package having a generally rectanguloidal shape is preferred as it facilitiates the manufacture, transportation, storage, display and marketing of the combined package.

It is desirable that the positions of multi-pack carton 12 and container 14 remain as fixed as possible relative to one another before and during the application of the packaging material. To accomplish this, as shown in FIG. 3, an adhesive sprayer 110 can be used to apply an adhesive either to face 12*a* of carton 12 or face 14*a* of container 14. When carton 12 and container 14 come into contact at junction 106, the two will be adhered together, and thus, carton 12 and container 14 can be maintained in mutual abutment as they continue along conveyor 108.

Preferably, conveyor 108 carries multi-pack carton 12 and container 14 into a wrap applicator 114 that places a sleeve or wrap of shrink film around carton 12 and container 14 in combination. Preferably, wrap applicator 114 accomplishes this through a series of stretch rollers that cover the combined package with complete 360 degree coverage, leaving only a "bullseye" opening 16*a* (see FIG. 1) on each end. A heater 116 then heats the shrink film to cause it to shrink into tight, surrounding engagement with carton 12 and container 14.

Preferably, wrap applicator 114 and heater 116 are parts of a shrink wrap machine 115, also known as a "heat shrink tunnel." After it has been shrunk, packaging material 16 contains multi-pack carton 12 and snack food container 14 in combination, with only the bullseye openings at each end remaining after combined package 10 has passed through heat shrink tunnel 115. Packages 10 can continue along conveyor 108, to a location (not shown) where they can be palletized or otherwise unloaded for storage and shipment.

Figure 5:
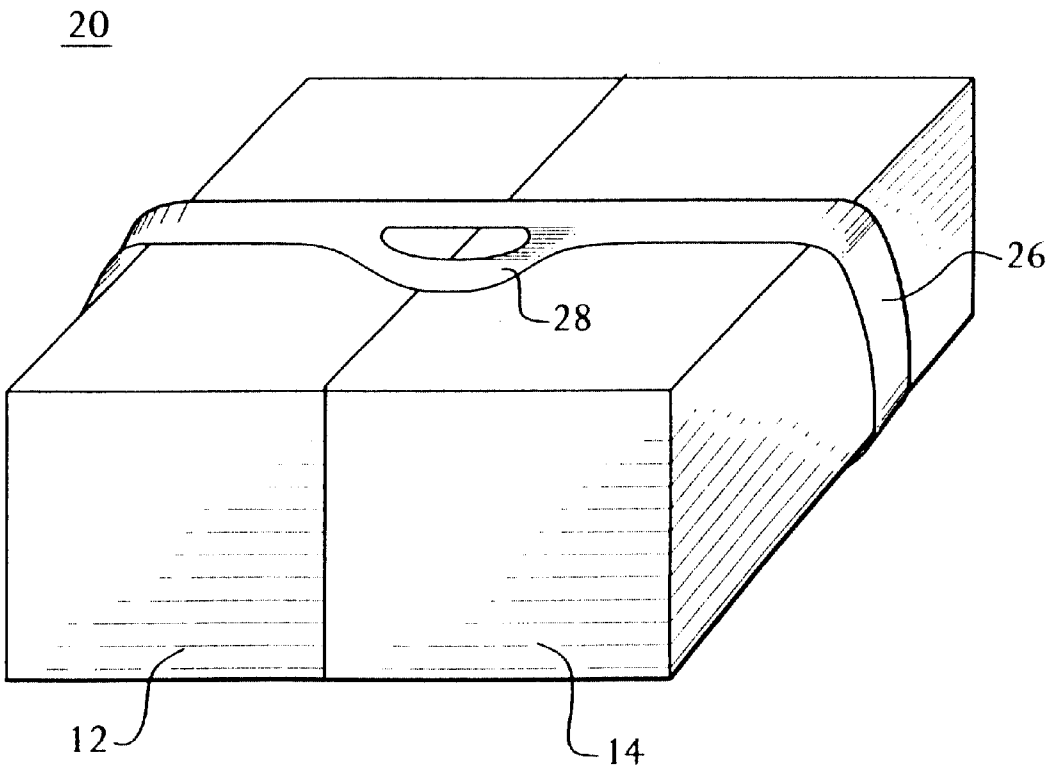
FIG. 5 depicts another preferred embodiment of a beverage package according to the present invention.

FIG. 5 depicts another preferred embodiment of a beverage package 20 according to the present invention. As shown, packaging material 26 can be a strap, belt, belly band, or any other configuration that wraps around four sides of the combined package 20, thereby holding multi-pack carton 12 and container 14 in mutual abutment. Preferably, packaging material 26 is made from a transparent or translucent polymeric material, though it may be desirable to use colored or printed packaging material to further enhance the marketing appeal of combined package 20. As shown, the packaging material 26 can include a handle 28, via which the combined package 20 can be lifted. Additional description of belly-bands can be found in U.S. Pat. Nos. 4,919,260 and 4,269,308, the contents of each of which are hereby incorporated herein by reference.

Figure 6:
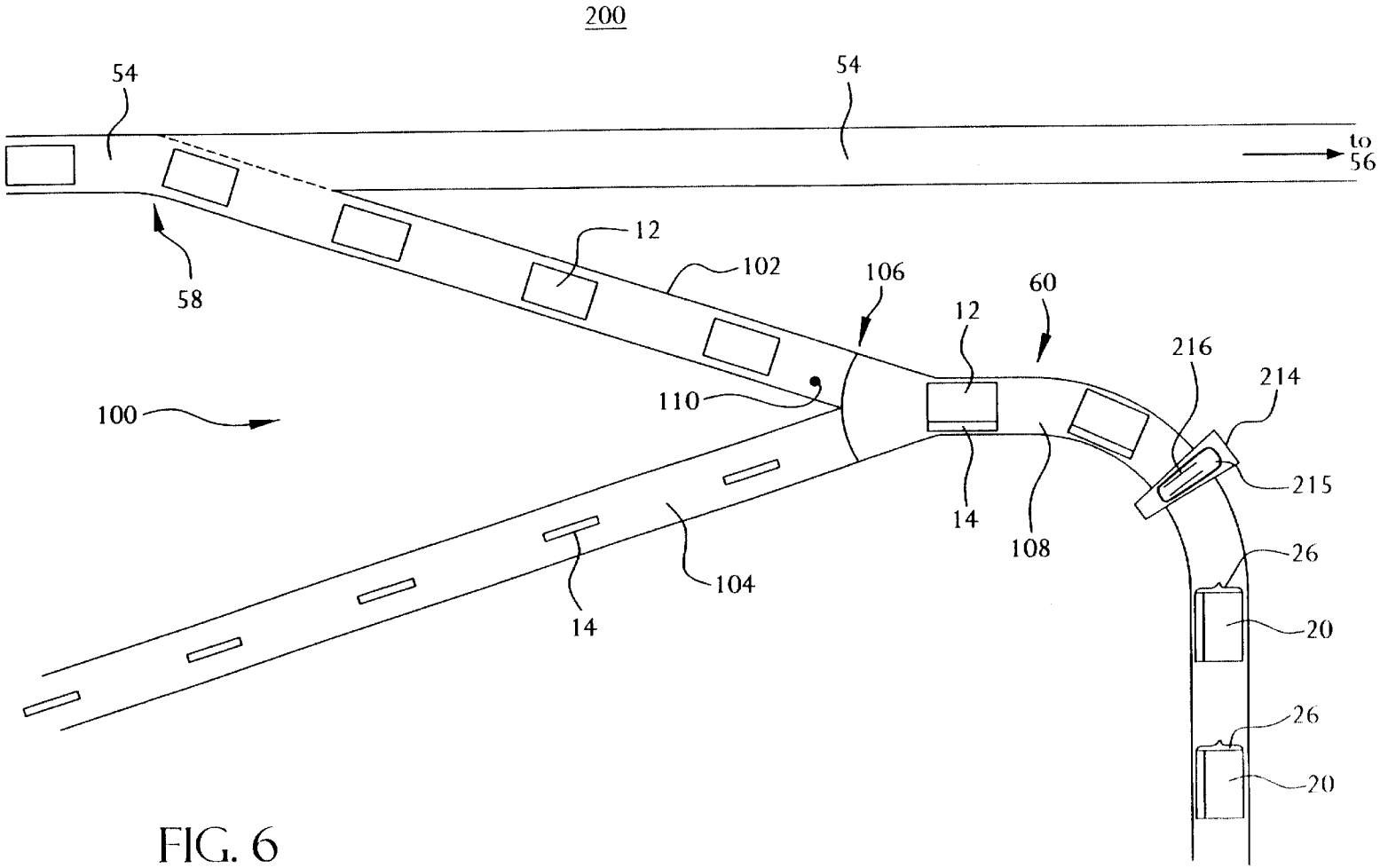
FIG. 6 depicts an alternative embodiment of apparatus according to the present invention for packaging combinations of multi-pack beverage cartons and complementary containers.

FIG. 6 depicts a preferred embodiment of apparatus 200 for manufacturing combined food and beverage packages 20, according to the present invention. As shown, conveyor 54 can include a switch 58 so that multi-pack cartons 12 can either continue along conveyor 54 to palletizing area 56, or be switched off via conveyor 102 to a packaging area 60. Alternatively, conveyor 102 can be separate from conveyor 54, with multi-pack cartons 12 being loaded onto conveyor 102 from a remote location (not shown).

In any event, conveyor 102 transports multi-pack cartons 12 at predefined intervals from one another (i.e., there is a predefined distance between successive cartons on conveyor 102). Similarly, a second conveyor 104 transports containers 14 at predefined intervals from one another. Conveyors 102 and 104 meet at a junction 106, where they can continue side-by-side. More preferably, conveyors 102 and 104 end at junction 106 where a third conveyor 108 begins. Thus, junction 106 can be adapted to cause the multi-pack carton and the container to be positioned adjacent to one another (e.g., to come into mutual abutment). The intervals between containers 14 should be set so that multi-pack cartons 12 and containers 14 arrive at junction 106 concurrently.

Preferably, multi-pack cartons 12 and containers 14 are oriented on their respective conveyors 102, 104 so that when multi-pack cartons 12 and containers 14 meet at junction 106, multi-pack cartons 12 and containers 14 abut against one another as shown. Additionally, in a preferred embodiment, wherein the overall shape of the combined package 20 is to be generally rectangular, multi-pack cartons 12 and containers 14 are oriented on their respective conveyors 102, 104 so that when they meet at junction 106, they are plumb with one another (i.e., the corresponding faces are generally co-planar as described above). It is anticipated that the combined package will be stronger if the faces are oriented in such a generally co-planar arrangement. This additional strength is desirable as it provides stability for transportation.

Thus, at junction 106, carton 12 and container 14 are positioned relative to one another such that face 12*a* of carton 12 is in abutment with face 14*a* of container 14 (see FIG. 5). It is desirable that the positions of multi-pack carton 12 and snack food container 14 remain as fixed as possible relative to one another before and during the application of the packaging material. To accomplish this, as shown in FIG. 6, an adhesive sprayer 110 can be used to apply an adhesive either to face 12*a* of carton 12 or face 14*a* of container 14. When carton 12 and container 14 come into contact at junction 106, the two will be adhered together, and thus, carton 12 and container 14 can be maintained in mutual abutment as they continue along conveyor 108.

Conveyor 108 carries multi-pack carton 12 and container 14 into a band applicator 214 that places a plastic strap, belt, or belly-band around carton 12 and container 14, thereby holding them in mutual abutment. Preferably, band applicator 214 includes a band roller 215. Band roller 215 is a roller or spool onto which a string of belly band material is wound. As the packages pass through band applicator 214, band roller 215 rotates and the belly band material unwinds from the spool 215. The belly band 26 is wrapped around the multi-pack beverage carton 12 and the complementary container 14 as they are held in mutual abutment. The belly band 26 is cut off of the spool 215, and the loose ends of the band 26 are fused together, via a heater, laser, or other such heat source 216, thereby holding the multi-pack carton 12 and complementary container 14 in mutual abutment to form the combined package 20.

Alternatively, the belly-band 26 can be wrapped around the multi-pack carton 12 and complementary container 14 like a rubber band. The heat source 216 can be used to shrink the belly band 26 snugly onto the multi-pack carton 12 and complementary container 14, thereby forming the combined package 20. Packages 20 can continue along conveyor 108, to a location (not shown) where they can be palletized or otherwise unloaded for storage and shipment.

Figure 7B:
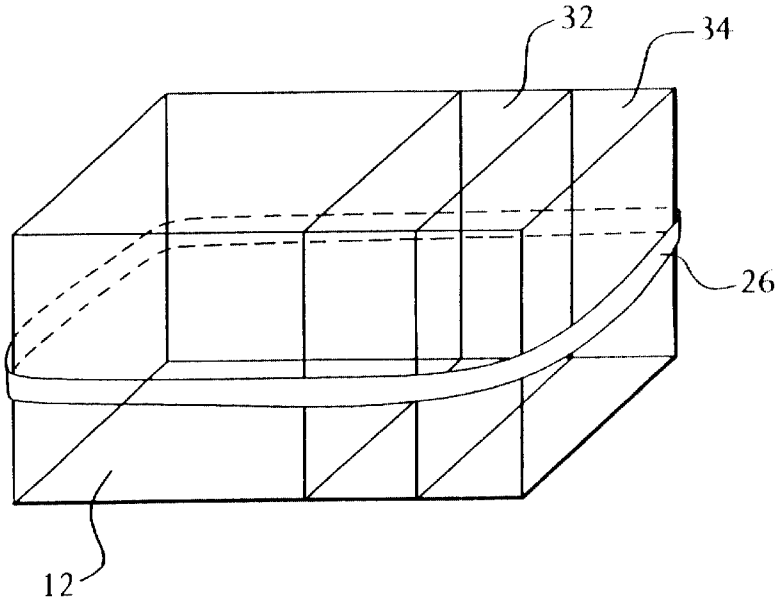
FIGS. 7A and 7B depict alternate embodiments of a combined package according to the invention that are particularly suitable for stacking.
Figure 7A:
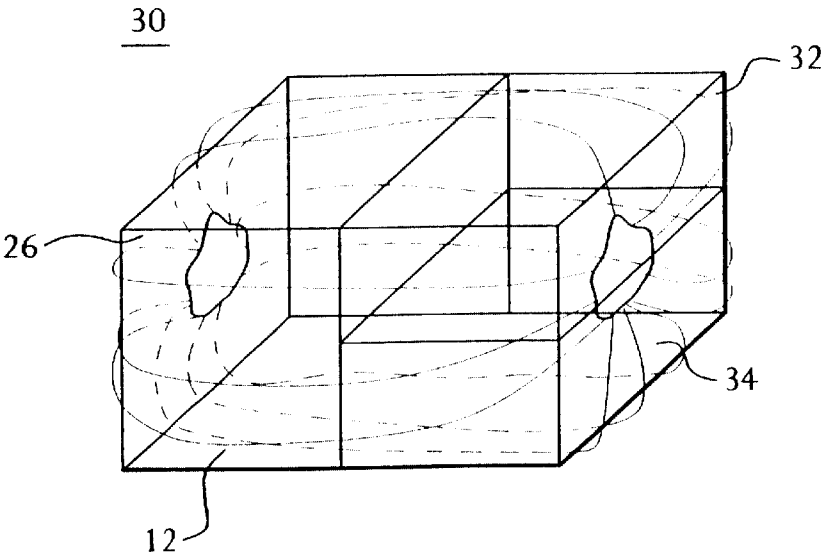

FIGS. 7A and 7B depict alternate embodiments of a combined package 30 according to the invention that are particularly suitable for stacking. As shown, package 30 includes a multi-pack beverage carton 12, a first complementary container 32, and a second complementary container 34. Such embodiments are particularly useful in applications wherein the seller of the combined package is desirous of marketing more than one complementary item with the beverage. For example, such an embodiment would be useful to sell beer, tortilla chips, and salsa as a single combined package. The complementary containers 32, 34 can be disposed such that each is adjacent to the multi-pack carton 12, as shown in FIG. 7A, or such that the first container 32 is adjacent the multi-pack carton 12 and the second container 34 is adjacent the first container 32, as shown in FIG. 7B. Alternatively, the multi-pack carton 12 can be situated between the complementary containers 32, 34. It is contemplated that the combined package 30 can include any number of multi-pack beverage cartons and any number of complementary containers. In any event, the multi-pack carton 12 and complementary containers 32 and 34 are preferably sized and shaped such that the overall shape of the combined package is generally rectanguloidal.

Those skilled in the art will appreciate that numerous changes and modifications may be made to the preferred embodiments of the invention and that such changes and modifications may be made without departing from the spirit of the invention. It is therefore intended that the appended claims cover all such equivalent variations as fall within the true spirit and scope of the invention.

I claim:

1. A combined package, comprising:

a multi-pack carton containing a plurality of individual containers each containing a first item;

a complementary container containing a second item that is complementary to and different from the first item, wherein the complementary container is separate from the multi-pack carton; and a packaging material at least partially surrounding both the multi-pack carton and the complementary container, wherein the packaging material applies to both the multi-pack carton and the complementary container a constrictive force that holds the multi-pack carton and the complementary container in mutual abutment.

2. The package of claim 1, wherein the individual containers are cans or bottles, and the carton contains at least six individual containers.

3. The package of claim 1, wherein the individual containers are cans or bottles, and the carton contains at least twelve individual containers.

4. The package of claim 1, wherein the packaging material is a sheet of polymeric material.

5. The package of claim 1, wherein the packaging material is transparent.

6. The package of claim 1, wherein the packaging material is a shrink-wrap material.

7. The package of claim 1, further comprising an adhesive between the carton and the complementary container that holds a face of the carton and a face of the complementary container in mutual abutment.

8. The package of claim 7, wherein each of the faces has a length, the lengths of the faces being approximately the same.

9. The package of claim 8, wherein each of the faces has a surface area, the surface areas of the faces being approximately the same.

10. The package of claim 1, wherein the packaging material is a band.

11. The package of claim 1, wherein the combined package has an overall shape that enables a plurality of said combined packages to be stacked next to as well as on top of one another on a pallet.

12. The package of claim 1, wherein the combined package has an overall shape that is generally rectanguloidal.

13. The package of claim 12, wherein each of the carton and the complementary container has a generally rectanguloidal shape.

14. A combined package, comprising:

a first, generally rectanguloidal container that contains a plurality of individual containers each containing a first item;

a second, generally rectanguloidal container that contains a second item, wherein the second item is different from and complementary to the first item, wherein the second container is separate from the first container; and a packaging material that applies to each of the containers a constrictive force that holds the containers in mutual abutment such that the combined package has an overall shape that enables a plurality of said combined packages to be stacked next to as well as on top of one another on a pallet.

15. The package of claim 14, wherein the packaging material is a sheet of polymeric material.

16. The package of claim 14, wherein the packaging material is a shrink-wrap material.

17. The package of claim 14, wherein the packaging material is a band.

18. The package of claim 14, wherein the first item is a beverage and the second item is a snack food.

19. The package of claim 14, wherein the individual containers are cans or bottles and the first container contains at least six individual containers.

20. The package of claim 14, further comprising an adhesive between the containers that holds a face of the first container and a face of the second container in mutual abutment.

21. The package of claim 20, wherein each of the faces has a length, the lengths of the faces being approximately the same.

22. The package of claim 21, wherein each of the faces has a surface area, the surface areas of the faces being approximately the same.

23. The package of claim 14, wherein the combined package has an overall shape that is generally rectanguloidal.

24. The package of claim 23, wherein each of the containers has a generally rectanguloidal shape.

25. The package of claim 14, wherein the first container has a first face that is generally coplanar with a respective first face of the second container.

26. The package of claim 14, wherein the first container has a plurality of faces, the second container has a plurality of faces, and each face of the first container is generally coplanar with a respective face of the second container.

27. The package of claim 14, further comprising a third, generally rectanguloidal container that contains a third item that is different from both of the first and second items and is complementary to at least one of the first and second items, wherein the packaging material at least partially surrounds the first, second, and third containers, thus holding the containers in mutual abutment.

28. A combined package, comprising:

a first container containing a first item, the first container having a first plurality of faces, and;

a complementary container containing a second item that is complementary to the first item, the second container having a second plurality of faces; and a packaging material that at least partially surrounds both the carton and the complementary container, thus holding the carton and the complementary container in mutual abutment such that each face of the first container is generally coplanar with a respective face of the second container.

29. The package of claim 28, wherein the packaging material is a sheet of polymeric material.

30. The package of claim 28, wherein the packaging material is a shrink-wrap material.

31. The package of claim 28, wherein the packaging material is a band.

32. The package of claim 28, wherein the packaging material applies a constrictive force to each of the containers to hold the containers in mutual abutment.

33. The package of claim 28, wherein the combined package has an overall shape that is generally rectanguloidal.

34. The package of claim 33, wherein each of the containers has a generally rectanguloidal shape.

35. The package of claim 28, further comprising a third container that contains a third item that is different from both of the first and second items and is complementary to at least one of the first and second items, wherein the packaging material at least partially surrounds the first, second, and third containers, thus holding the containers in mutual abutment.

36. The package of claim 28, wherein the first container is separate from the second container.

* * * * *

UNITED STATES PATENT AND TRADEMARK OFFICE

CERTIFICATE OF CORRECTION

PATENT NO. : 6,688,462 B2
APPLICATION NO. : 10/037893
DATED : February 10, 2004
INVENTOR(S) : Forrest Kelly Clay It is certified that error appears in the above-identified patent and that said Letters Patent is hereby corrected as shown below:

Column 9, Line 8 of Claim 28, delete “carton” and insert --first container-- therefor;

Column 9, Line 9 of Claim 28, delete “carton” and insert --first container-- therefor.

Signed and Sealed this

Fifth Day of December, 2006

JON W. DUDAS
*Director of the United States Patent and Trademark Office*